US005752839A

United States Patent [19]

Fiacco et al.

[11] Patent Number: 5,752,839

[45] Date of Patent: May 19, 1998

[54] COAXIAL CONNECTOR FOR PRESS FIT MOUNTING

[75] Inventors: Richard A. Fiacco, Bayville, N.J.; Keith A. Rosborough, St. Charles, Ill.

[73] Assignee: Labinal Components and Systems, Inc., Lombard, Ill.

[21] Appl. No.: 497,292

[22] Filed: Jun. 30, 1995

[51] Int. Cl.[6] ..... H01R 17/04

[52] U.S. Cl. ..... 439/63; 439/78

[58] Field of Search ..... 439/63, 581, 78

[56] References Cited

U.S. PATENT DOCUMENTS

| | | | |
|---|---|---|---|
| 23,447 | 4/1859 | Christian et al. | 417/529 |
| 701,112 | 5/1902 | Watkins | 5/264.1 |
| 2,238,834 | 4/1941 | Travers | 439/461 |
| 3,109,997 | 11/1963 | Giger et al. | 333/8 |
| 3,179,912 | 4/1965 | Huber et al. | 339/17 |
| 3,206,540 | 9/1965 | Cohen | 174/89 |
| 3,335,388 | 8/1967 | Karol | 339/18 |
| 3,384,703 | 5/1968 | Forney, Jr. et al. | 174/75 |
| 3,406,376 | 10/1968 | Varrin | 339/258 |
| 3,437,960 | 4/1969 | Ziegler, Jr. | 333/97 |
| 3,745,514 | 7/1973 | Brishka | 339/91 R |
| 3,781,763 | 12/1973 | Fesser et al. | 339/91 P |
| 3,825,874 | 7/1974 | Peverill | 339/14 R |
| 3,828,305 | 8/1974 | Hogendobler | 339/177 R |
| 3,848,164 | 11/1974 | Otte | 317/256 |
| 3,871,735 | 3/1975 | Herrmann, Jr. | 339/177 R |
| 3,879,103 | 4/1975 | Peltola et al. | 339/177 R |
| 3,910,665 | 10/1975 | Stull | 339/17 C |
| 4,119,359 | 10/1978 | Schultz | 339/128 |
| 4,165,911 | 8/1979 | Laudig | 339/89 |
| 4,230,385 | 10/1980 | Ammon et al. | 339/17 R |
| 4,231,629 | 11/1980 | Kirby | 339/17 M |
| 4,377,320 | 3/1983 | Lathrop et al. | 339/177 R |
| 4,412,717 | 11/1983 | Monroe | 339/177 R |

(List continued on next page.)

FOREIGN PATENT DOCUMENTS

| | | |
|---|---|---|
| 46120/85 | 2/1986 | Australia . |
| 0 090 538 | 10/1983 | European Pat. Off. . |
| 0651467A2 | 5/1995 | European Pat. Off. . |
| 1157274 | 3/1958 | France . |
| 21459 | 6/1961 | German Dem. Rep. . |
| 2 335 361 | 2/1974 | Germany . |
| 1 480 724 | 7/1977 | United Kingdom . |
| 2274356 | 7/1994 | United Kingdom . |

OTHER PUBLICATIONS

IBM Technical Disclosure Bulletin, vol. 33, No. 4, pp. 216–218, Sep. 1990.

6 photographs of a coaxial connector with the name "AMP" available to the applicant in approximately May 1994.

9 pages of product information on BNC connectors from AMP Incorporated one page undated and other pages dated 1988 or 1991.

Front and rear cover pages and pages 202–209 from catalog by M/A–COM Inc., Interconnect Division, Waltham, MA, copyright 1994.

*Primary Examiner*—Neil Abrams
*Attorney, Agent, or Firm*—Leydig, Voit & Mayer, Ltd.

[57] ABSTRACT

Electrical connectors are provided which include a hollow housing formed of electrically conductive metal, a dieletric sleeve which fits into the housing and a resilient roll-formed central signal-carrying contact that is retained by one-way press fit engagement in the dieletric sleeve. The housing is upset against the dielectric sleeve, as by staking, to assure retention of the dieletric sleeve therein. The housing includes mounting legs which are straight and are polygonal in cross-section for press-fit engagement in openings in a circuit board to mount the connector. The legs on one side of the body have cross-sections at different angular orientations relative to a radius of the body than the legs on another side. Upon removal of one such connector and replacement by a connector rotated to a different angular position than the previously installed connector, the corners of the various legs of the replacement connector will engage the periphery of each respective mating hole of the board in sectors which were not grooved by the previous insertion of a like connector, for secure press-fit mounting.

20 Claims, 4 Drawing Sheets

U.S. PATENT DOCUMENTS

| | | | |
|---|---|---|---|
| 4,451,107 | 5/1984 | Dola et al. | 339/143 R |
| 4,453,796 | 6/1984 | Monroe | 339/177 R |
| 4,519,665 | 5/1985 | Althouse et al. | 339/147 R |
| 4,548,453 | 10/1985 | Mummey et al. | 339/17 C |
| 4,569,567 | 2/1986 | Zucchini | 339/154 A |
| 4,603,926 | 8/1986 | Nesbit et al. | 339/17 C |
| 4,645,288 | 2/1987 | Stursa | 339/177 R |
| 4,664,464 | 5/1987 | Hutter et al. | 339/103 R |
| 4,664,467 | 5/1987 | Tengler et al. | 339/177 R |
| 4,684,200 | 8/1987 | Capp | 439/387 |
| 4,718,854 | 1/1988 | Capp et al. | 439/63 |
| 4,734,043 | 3/1988 | Emert et al. | 439/571 |
| 4,846,731 | 7/1989 | Alwine | 439/651 |
| 4,875,865 | 10/1989 | Demler, Jr. et al. | 439/101 |
| 4,909,746 | 3/1990 | Scholz | 439/82 |
| 4,941,831 | 7/1990 | Tengler et al. | 439/63 |
| 4,964,805 | 10/1990 | Gabany | 439/63 |
| 4,969,259 | 11/1990 | Macek et al. | 29/845 |
| 4,990,105 | 2/1991 | Karlovich | 439/578 |
| 5,062,811 | 11/1991 | Hackman | 439/620 |
| 5,078,619 | 1/1992 | Whittle et al. | 439/578 |
| 5,145,408 | 9/1992 | Houtteman et al. | 439/581 |
| 5,215,470 | 6/1993 | Henry et al. | 439/63 |
| 5,219,299 | 6/1993 | Wang | 439/18 |
| 5,244,412 | 9/1993 | Hatch et al. | 439/567 |

COAXIAL CONNECTOR FOR PRESS FIT MOUNTING

This invention relates to electrical connectors and particularly to small coaxial connectors for mounting in a printed circuit board or a similar mating member by press-fit engagement of legs on the connector into openings in the respective member.

BACKGROUND OF THE INVENTION

Many forms of connectors have been provided for terminating coaxial cables to circuit boards, including printed circuit boards with plated through holes, or to similar back plane members. (Such boards and members are referred to collectively hereinafter as "circuit boards".) The subject connectors often include prongs, pins or legs (hereinafter referred to generally as "legs") that are connected to a tubular shell and are press-fit into a matching array of openings in a relatively thick circuit board for mounting and retaining the connector assembly on the board as well as for effecting electrical connection of the shielding to appropriate ground circuits. Such connectors typically include an insulating sleeve within the tubular shield and a contact pin extending through that sleeve. The upper end of the contact pin is accessible for mating with the signal pin of a mating coaxial connector and a lower end is available for engaging a signal circuit on or in the board on which the connector is mounted.

It is desirable that such connectors be of simple and economical construction, and easy to mount, while providing secure retention of the connector on the board and reliable electrical interconnection with the circuitry of the board, without auxiliary attachment steps or devices such as soldering or other hardware for attachment purposes. That is, it is preferred that the press fit between the receptacle and the circuit board be the only retention means which secures the receptacle in place.

Further, it is desirable that the center contact provide a true compliant connection with the circuit contact(s) of the mounting board and that this connection be effected simultaneously in the press fit mounting of the connector to the board.

Such connectors often are utilized in extensive and/or complex assemblies where an individual connector is of minor cost as compared to the overall assembly. It is desirable that the individual connectors be replaceable by the same press-in mounting technique to permit ready replacement of a faulty or inappropriate connector without the need to replace the complex and expensive assembly and without requiring special replacement attachment steps or hardware whenever it becomes necessary to change a connector.

It is the object of this invention to provide improved connector devices which meet the aforenoted requirements and provide such beneficial results.

SUMMARY OF THE INVENTION

Electrical connectors are provided which include only three parts, namely a hollow housing formed of electrically conductive metal, such as die cast zinc, a dieletric sleeve which fits into the housing and a resilient central signal-carrying contact that is retained by one-way press fit engagement in the dieletric sleeve. The housing is upset against the dielectric sleeve, as by staking, to assure retention of the dieletric sleeve therein. In the preferred embodiment, the contact pin is a roll-formed pin which is resiliently compliant in cross-section at each end for yieldable mating engagement with a contact of a mating connector and with circuit components of the circuit board on which the connector is mounted. The housing serves as a conducting ground shield and includes integral mounting legs to be press fit into appropriate openings in the receiving circuit board to retain the receptacle on that board and also connect with appropriate grounding conductors on the receiving circuit board.

The mounting legs are straight and are polygonal in cross-section, e.g. rectangular, and are of cross-sectional dimensions slightly greater than the openings in the circuit board whereby the press-fit of the mounting legs tends to cut or impress mating grooves in the walls of the openings of the circuit board. The legs on one side of the body are disposed with their cross-sections at different angular orientations relative to a radius of the body than the legs on another side. Thereby, upon removal of one such connector and replacement by a connector rotated to a different angular position than the previously installed connector, e.g. a 180° reversal, the corners of the various legs of the replacement connector will engage the periphery of each respective mating hole in virgin sectors of that hole, i.e. in sectors which were not grooved by the previous insertion of a like connector.

Thus the subject connectors may be removed and replaced at least once in the same set of mounting holes with essentially the same retentive mounting engagement being obtained by simple press-fit insertion-type remounting as was obtained with the original press-fit mounting. Further, the subject connectors are of simple three-piece construction.

Figure 1:
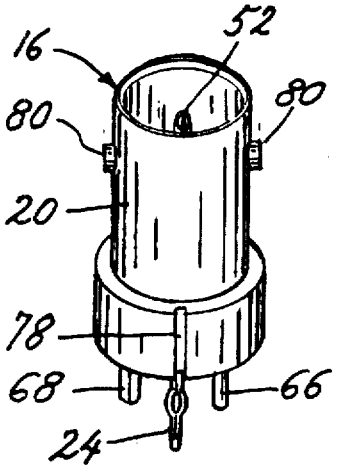
FIG. 1 is a perspective view of a coaxial electrical connector employing teachings of this invention.

While the invention will be further described in connection with certain preferred embodiments, it is not intended to limit the invention to those embodiments. On the contrary, and as noted further below, it is intended to cover all alternatives, modifications and equivalents as may be included within the spirit and scope of the invention.

DETAILED DESCRIPTION OF PREFERRED EMBODIMENTS

Referring to the enclosed drawings, the connector device 16 is a coaxial receptacle connector for mounting on a thick printed circuit board or similar mounting member, which is referred to herein generically as a "circuit board". The subject connector is of a type sometimes referred to as a "BNC" receptacle or connector. The connector 16 is specifically designed to be press-fit into a circuit board 18 where it serves as a receptacle for mating connection of a conventional type of coaxial plug connector. Such a conventional mating plug connector includes a cylindrical shield for mating with the conductive shielding body 20 of the connector 16, and a central signal contact pin within that shield which mates with the center contact pin 24 of the conductor 16.

Figure 4:
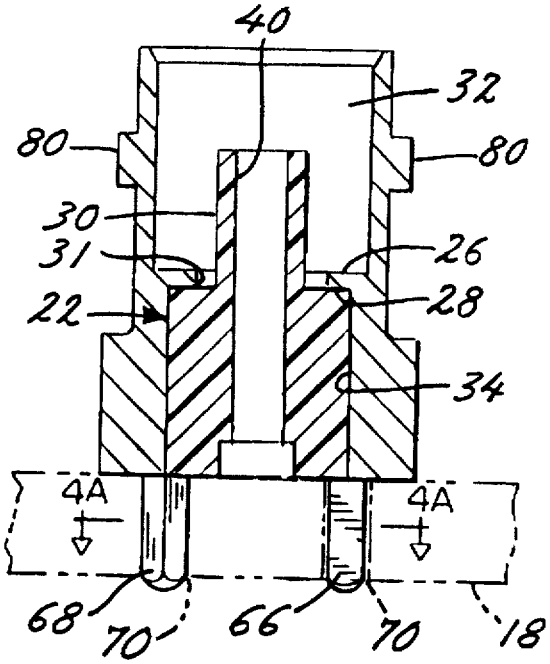
FIG. 4 is a sectional view of the connector of FIG. 1 without the contact pin and with a mating board shown in dashed lines.
Figure 4A:
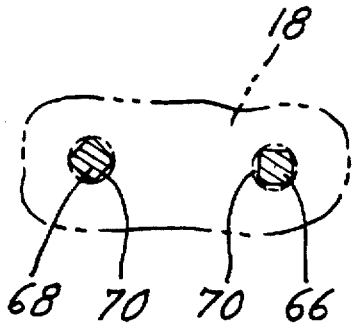
FIG. 4A is a sectional view taken along line 4A—4A of FIG. 4.
Figure 6:
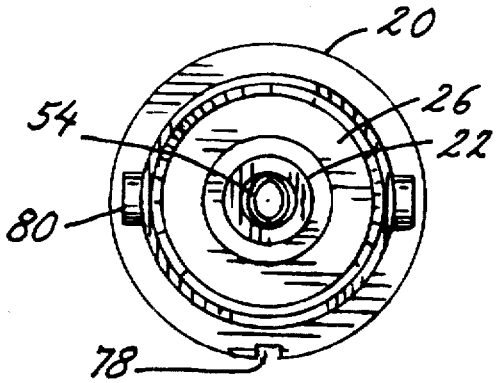
FIGS. 6 and 7 are top and bottom views respectively of the same connector.
Figure 5:
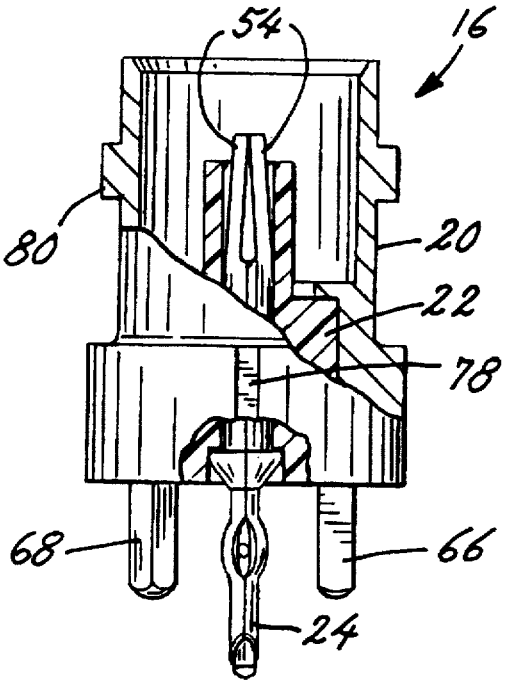
FIG. 5 is a side view, partially in section, of the connector of FIG. 1.
Figure 7:
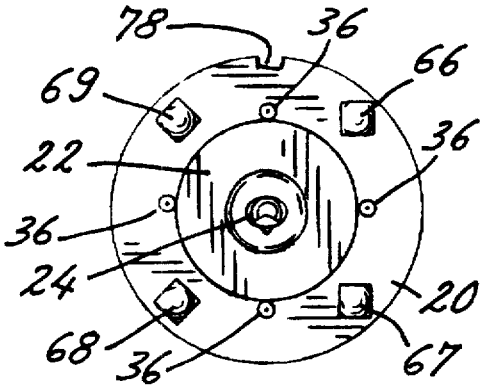

The subject receptacle connector 16 is formed of only three parts, namely a hollow tubular housing 20 formed of a conductive metal, such as by die casting zinc, a dielectric insert 22 preferably formed of Teflon and that fits within the lower end portion of the housing 20, and a center signal carrying contact 24. The housing 20 includes an internal annular flange or lip portion 26 that forms a lower shoulder 28 against which the cylindrical dieletric member 22 is seated. In this seated position, a cylindrical neck portion 30 of the dieletric member protrudes through a center opening 31 in the flange 26 and into the upper connector chamber 32 of the housing, as seen in FIGS. 4 and 5. The dieletric element 22 may be press-fit in the lower housing chamber 34 for retention purposes. Whether or not it is press-fit in place, preferably it is retained by upsetting a portion of the housing wall inward against and/or into the dieletric body, such as by staking at one or more points about its periphery after the dieletric element 22 has been inserted in its seated position, e.g. as indicated at 36 in FIG. 7.

The central contact pin 24 is received through a central opening 40 which extends through the dieletric element 22, coaxial with the connector 16. The pin 24 includes a pair of diametrically opposing external protuberances 42 which are struck from the pin body and slope outwardly from the normal outer surface of the pin in a direction towards the contact tail of the element 24 and terminate in sharp shoulders 44. The pin 24 is press-fit into the opening 40, from the lower end as seen in the drawings, to a seated position in which a shoulder 46 on the pin 24 abuts a shoulder 48 at the inner end of a boss 50 in the lower end of the dieletric member 22. As noted further below, the pin 24 is formed of resilient material. The protuberances are resiliently compressible radially inward to accommodate the force fit of the pin 24 in the opening 40 and to effect engagement of the shoulders 44 with or into the surface of the member 22. Thereby the press-fit engagement in the dieletric element, and particularly the engagement of the shoulders 44 with the inner wall of the dieletric which defines the opening 40, effects retention of the center contact in its assembled position as in FIG. 5.

Figure 9:
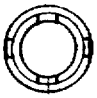
FIGS. 9 and 10 are top and bottom end views, respectively, of the pin of FIG. 8.
Figure 9A:
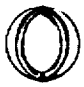
FIG. 9A is a top end view of the contact pin as in FIG. 8A.

In the illustrated preferred embodiment, the contact pin 24 is formed by stamping and roll-forming appropriate resilient conductive sheet material in a generally known manner. The mating receptacle end portion 52 is bifurcated by a slot 53 to form opposed arcuate segments 54. In the course of manufacture, the segments 54 are upset towards one another as in FIG. 8A to form a narrowed, radially resilient spring contact opening as in FIG. 9A for receiving and effecting reliable electrical contact with the contact pin of a mating connector which slides into this end opening when the connectors are mated in the usual manner. The sleeve portion 30 of the dieletric element 22 provides support and protection for the receptacle end portion 52 of the contact 24.

Figure 2:
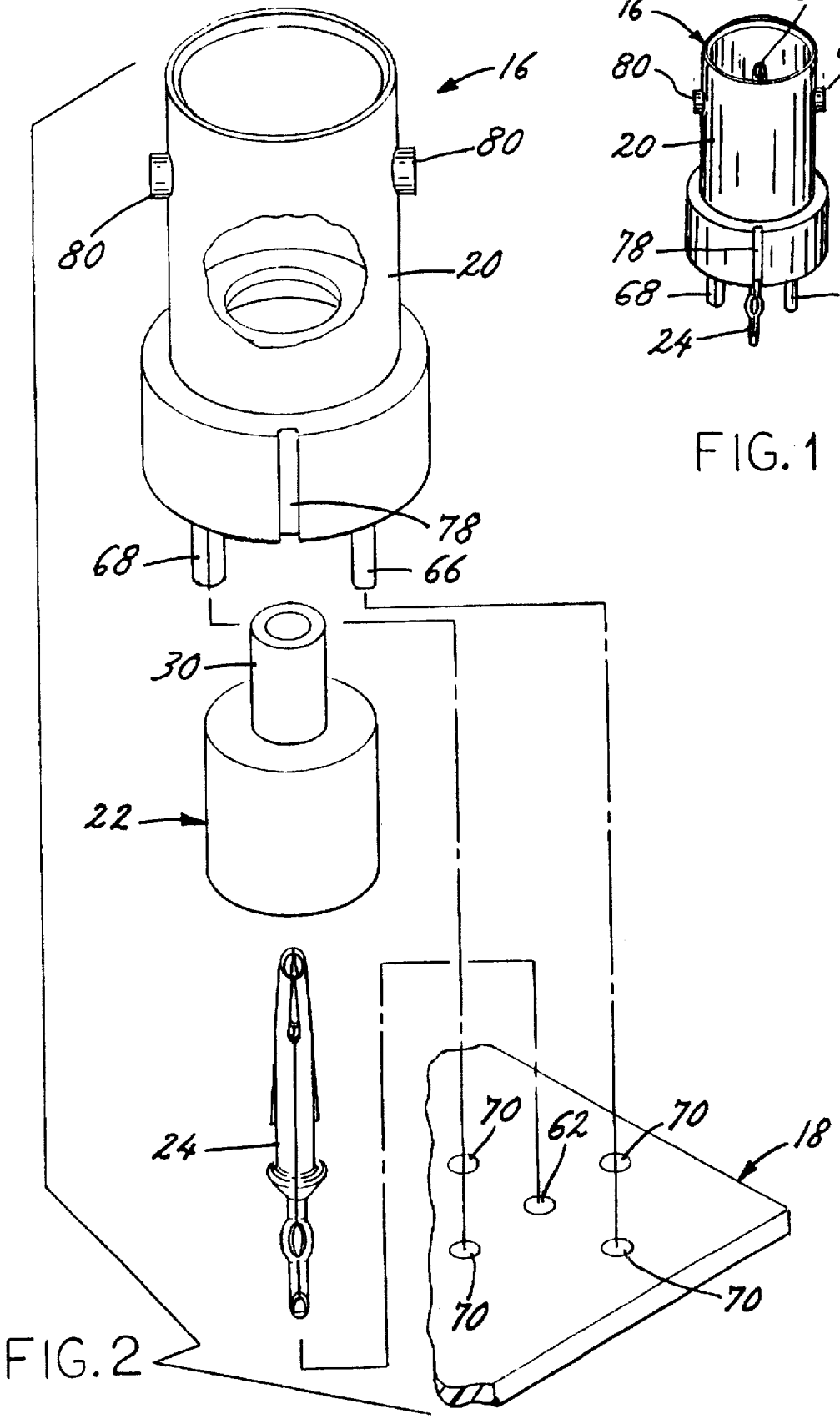
FIG. 2 is an exploded perspective view of the connector of FIG. 1 and a portion of a mounting board with an array of openings in which the subject connector is to be mounted.
Figure 3:
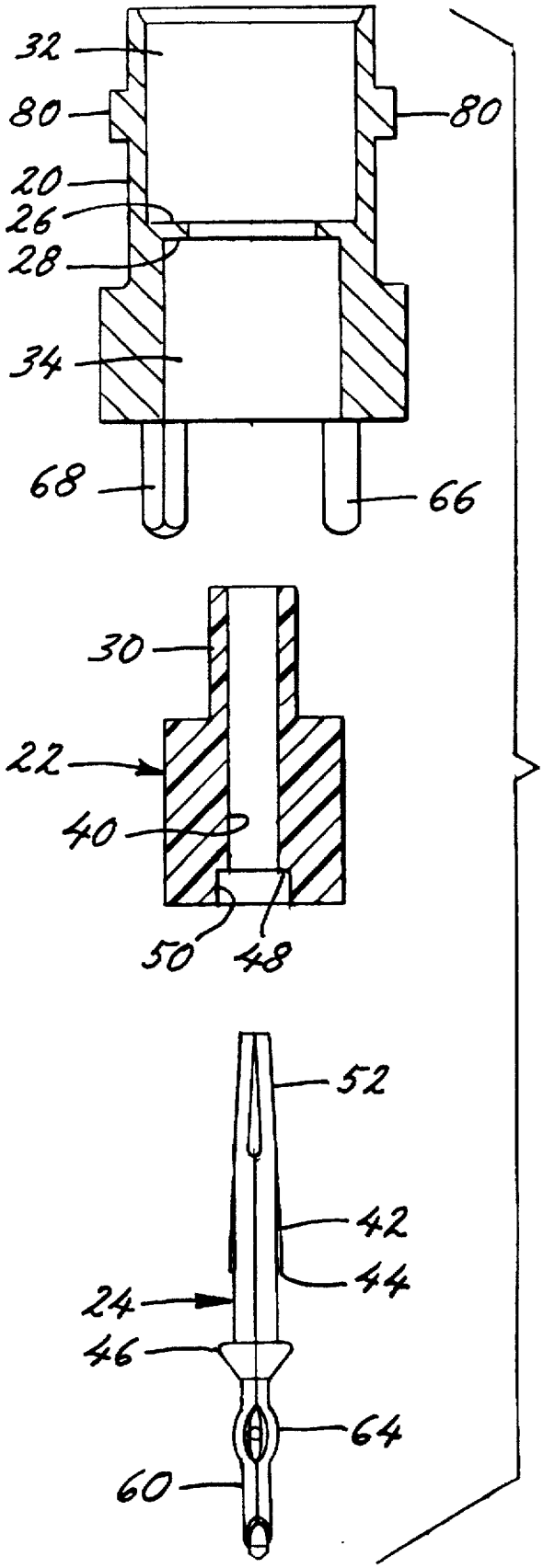
FIG. 3 is an exploded center sectional view of the connector of FIG. 1.
Figure 8:
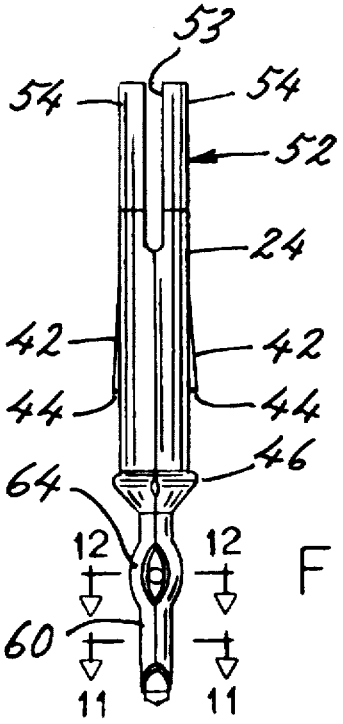
FIG. 8 is a side view of the contact pin of the connector of FIG. 1 prior to upsetting of the receptacle end.
Figure 8A:
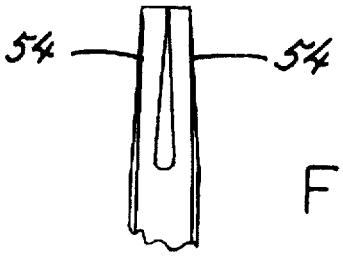
FIG. 8A is a schematic side view of the receptacle end of the pin of FIG. 8, in its normal upset configuration.
Figure 10:
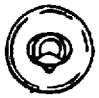
Figure 11:
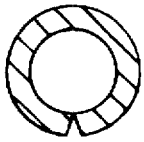
FIGS. 11 and 12 are sectional views of the contact tail of the contact pin taken along lines 11—11 and 12—12 in FIG. 8, respectively.
Figure 12:
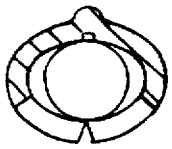

The tail end portion 60 of the contact 24 protrudes below the mounting end of the body 20 for connection to an appropriate signal circuit. Such connection may be effected by press-fitting this tail into an opening in a circuit board, such as the center opening 62 as seen in FIG. 2. For example, the opening 62 may be plated-through for contact of the tail portion 60 with the appropriate circuit of board 18, or the opening may expose an annular contact portion of a conductive layer through which it passes, or the tail portion 60 may be engaged by a complementary mating element or by other connectorization techniques. The tail 60 is of the roll-formed type having a bulbous enlarged portion 64 which is resilient in radial compression by virtue of the spreading of the two opposed portions, as best seen in FIGS. 5, 8 and 12; that is, the tail portion 62 is resiliently compliant in cross-section for yieldable mating engagement in the opening 62 or with another connector, in a known manner.

The body 20 includes four mounting legs 66, 67, 68 and 69 to be press-fit into openings 70 in the circuit board 18 for mounting and thereby retaining the receptacle on the board. These mounting legs are formed integral with the cylindrical portion of the body 20, as by being part of the unified casting which forms the body. These legs also electrically connect the body, which is in the ground shield circuit, to appropriate grounding conductors on the circuit board.

Each of the legs 66–69 is of a regular polygonal, i.e. square, cross-section and is of straight untwisted configuration extending parallel to the longitudinal mounting axis of the connector 16. All of the pins are at the same radius from the central axis of the connector 16 and are spaced in equal angular relation thereabout, the same as the array of the openings 70 about the opening 62 in the board 18. The corners of the legs are relative sharp, though they may be slightly rounded as is intrinsic in the die casting of such components. The maximum cross-sectional dimensions, i.e. across the diagonal of each leg, are slightly greater than the nominal inside diameter of the openings 70, which also are of uniform size. Thereby the press-fit of the mounting legs into the openings 70 tends to cut or impress mating grooves in the circuit board, extending longitudinally along the walls of the respective openings 70, 70.

If a connector 16 is removed, remounting of another connector with legs of the same size and orientation would result in an insecure or unreliable mounting of the replacement connector because the gripping edges of the legs would reenter the same "grooves" as formed by the previously inserted connector. However, the legs 68 and 69 are oriented such that their cross-sections are rotated 45° relative to the orientation of the cross-section of the other two legs 66 and 67; see particularly FIG. 7. The differentiating rotational orientation of the legs permits reuse of a connector position in a circuit board, such as following removal of a defective connector 16, with full retention engagement of the replacement connector 16 simply by positioning the replacement connector 180° from the orientation of the removed connector. It will be appreciated that this differential angular orientation results in the corners of the respective polygonal legs 66–69 pressing new grooves in the walls of the openings 70 in the "virgin", i.e. un-grooved, segments of those walls between the grooves formed by the first-inserted connector. This permits replacement of a relatively inexpensive connector by a simple press-fit insertion of the replacement connector 16 with substantially the same retentive engagement as an original connector 16. Replacement of the relatively expensive overall circuit board assembly or the use of special securement and contacting hardware techniques in replacing a connector are avoided.

It is convenient to the user, and therefor preferred, to provide a readily visible indicia on the external surface of the connector housing 20, as at 78 in FIG. 2, as a reference to the user in respect to the orientation of the respective legs 68–69. The illustrated connector 16 is formed with diametrically oppositely extending short external cylindrical ears 80 for bayonet type securing interconnection with a mating connector element, in a known manner. When assembling recepticals 16 on a circuit board, it is desirable to always have the ears 80 in the same orientation whereby the mating connectors may be attached in the same manner and orientation. By providing the legs on one-half of the connector of one orientation, e.g. the legs 66 and 67 in the illustrated embodiment, and the legs on the other half of a different orientation, e.g. legs 68 and 69 in the illustrated embodiment, reversal of a replacement connector 16 relative to a preceding connector will insure that each leg of the replacement connector will form its own new grooves for secure mounting to the circuit board.

Because the legs are straight, that is not twisted, the impressed grooves will be straight and uniformly spaced, leaving undisturbed virgin segments of the walls of the opening 70 between the respective grooves formed by each corner of a leg 68–69 in a mounting of the connector 16. Replacement of a connector 16 by another connector rotated 180° places the engaging corners of the respective legs in these virgin areas when inserting the replacement connector. While the illustrated legs are of square cross-sections, it will appreciated that the legs may be formed with cross-sections defining other polygons of a reasonable number of sides. The number of sides of polygonal cross-sections which will serve satisfactorily will depend somewhat upon the size of the legs and the receiving openings. However, it is believed that the polygon should be of eight sides or less. The configurations should provide spacings between the grooves formed during a first insertion which spacings afford adequate undisturbed wall segments between those first grooves for engagement by the corners of other legs within such undisturbed segments as the removed connector or another connector is inserted with legs of different angular orientation in the respective openings. Similarly, by appropriate attention to the geometry involved, substantially the same results can be obtained by providing legs of different cross-sections on the different circumferential segments of the same connector.

Thus it will be seen that improved connectors have been provided which meet the aforestated objects. Further, while particular embodiments of the invention have been shown and are described, it will be understood that the invention is not limited thereto since modifications may be made by those skilled in the art, particularly in light of the foregoing teachings. It is, therefor, contemplated by the appended claims to cover any such modifications as incorporate those features which constitute the essential features of these improvements within the true spirit and scope of the invention.

What is claimed is:

1. An electrical connector having a body with a central mounting axis and a plurality of parallel straight untwisted mounting legs protruding from one side of said body for mating with openings disposed in a predetermined array in a circuit board, said mounting legs formed of an electrically conductive material, said legs extending parallel to said axis and being disposed in a predetermined array around said axis for force-fit engagement with the sidewalls of such openings in a circuit board in at least two different rotational positions of said connector about said axis relative to said circuit board for mounting said connector on said circuit board when said legs are forced into such openings in each of said different rotational positions, and all other protrusions on said one side of said connector intended for mating with such a circuit board being mateable therewith in each of said different rotational positions, wherein each of said legs is of polygonal cross-section having spaced exposed external corners about its periphery and is of substantially the same maximum outer cross-sectional dimensions as the remaining said legs, each of said legs being of slightly greater outermost diagonal dimensions across said corners than the corresponding dimensions across such openings for sliding compressive engagement of said corners with the walls of such openings, and certain said legs being of a significantly different cross-sectional configuration than others of said legs relative to a radial plane through said axis and the center of the respective leg, whereby said corners of said certain of said legs will compressively engage the walls of the respective openings at significantly different angular positions than said corners of the others of said legs when said connector is mounted on such a circuit board, and said certain legs and said other legs being disposed in said predetermined array of said legs such that in each of said relative rotational positions of said connector each of said legs mates into an opening of such circuit board array that is engaged by one of said legs of a different cross-sectional configuration in another of said rotational positions, whereby, following removal of one said electrical connector previously mounted in one such array of holes in one such rotational position, said legs of a said connector inserted in the same array of holes but in a different relative rotational position results in said external corners of each of said legs of the latter connector engaging said walls of said openings in significantly different positions than said corners of said legs of the previously inserted connector.

2. The invention as in claim 1 wherein all of said legs are of the same cross-sectional configuration and the legs on one side of said axis are of a different orientation relative to the respective radial planes therethrough than the legs on the other side of said axis.

3. The invention as in claim 2 wherein said connector includes means for mating another connector to said body only in either of two opposite angular positions relative to said mounting axis.

4. The invention as in claim 2 wherein said connector includes a bayonet connection for mounting another connector therewith on the side of said body opposite said legs and generally coaxial with said mounting axis.

5. The invention as in claim 1 wherein each of said legs is of a cross-section defining a regular polygon of eight or less sides.

6. The invention as in claim 1 wherein each of said legs is of a cross-section defining a regular polygon of four sides.

7. The invention as in claim 1 wherein said body and legs are an integral unit formed of the same conductive material.

8. The invention as in claim 1 wherein said body and said legs are a one-piece electrically conductive metal element.

9. The invention as in claim 1 wherein said connector completes an electrical connection with conductors on such a circuit board.

10. The invention as in claim 1 wherein said connector is a coaxial receptacle connector, said body being a conductive shield and said legs providing an electrical connection with grounding conductors on such a circuit board.

11. The invention as in claim 10 including a signal contact pin which extends generally along such axis and protrudes from said body on the same side as said legs and parallel to said legs for connection with a signal circuit in such a circuit board on which said connector is mounted by such engagement of said legs in holes in the circuit board.

12. The invention as in claim 11 wherein said signal contact pin is supported in said body by a hollow cylindrical dielectric member which engages with said body for supporting said contact pin and said dielectric member in said body.

13. The invention as in claim 12 wherein said dielectric member is a one-piece element.

14. The invention as in claim 13 wherein said connector consists only of one signal contact pin, said dielectric member, and a one-piece electrically conductive element which comprises a cylindrical shield body and said legs.

15. An electrical connector having a body with a central mounting axis and a plurality of parallel straight untwisted mounting legs protruding from one side of said body for mating with openings disposed in a predetermined array in a circuit board, said mounting legs formed of an electrically conductive material, said legs extending parallel to said axis and being disposed in a predetermined array around said axis for force-fit engagement with the sidewalls of such openings in a circuit board in at least two different rotational positions of said connector about said axis relative to said circuit board for mounting said connector on said circuit board when said legs are forced into such openings in each of said different rotational positions, and all other protrusions on said one side of said connector intended for mating with such a circuit board being mateable therewith in each of said different rotational positions, wherein each of said legs is a rigid solid element having angularly spaced exposed external corners about its periphery and is of substantially the same maximum outer cross-sectional dimensions as the remaining said legs, each of said legs being of slightly greater outermost diagonal dimensions across said corners than the corresponding dimensions across such openings for sliding compressive engagement of said corners with the walls of such openings, and certain said legs having said corners thereof in significantly different angular positions than others of said legs relative to a radial plane through said axis and the center of the respective leg, whereby said corners of said certain of said legs will compressively engage the walls of the respective openings at significantly different angular positions than said corners of the others of said legs when said connector is mounted on such a circuit board, and said certain legs and said other legs being disposed in said predetermined array of said legs such that in each of said relative rotational positions of said connector each of said legs mates into an opening of such circuit board array that is engaged by one of said legs of a different cross-sectional configuration in another of said rotational positions, whereby, following removal of one said electrical connector previously mounted in one such array of holes in one such rotational position, said legs of a said connector inserted in the same array of holes but in a different relative rotational position results in said external corners of each of said legs of the latter connector engaging said walls of said openings in significantly different positions than said corners of said legs of the previously inserted connector.

16. A coaxial electrical connector including a generally cylindrical hollow body which includes a cylindrical sidewall defining a bore therethrough and a plurality of parallel straight untwisted legs integral with said side wall and protruding at one end of said body for mating with openings disposed in a predetermined array in a circuit board, said body and legs formed of an electrically conductive material, said legs being disposed, in a predetermined array for force-fit engagement with the sidewalls of such openings in a circuit board in at least two different rotational positions of said connector about said axis relative to said circuit board for mounting said connector on said circuit board when said legs are forced into such openings in each of said different rotational positions, and all other protrusions on said one side of said connector intended for mating with such a circuit board being mateable therewith in each of said different rotational positions, wherein each of said legs is of polygonal cross-section having spaced exposed external corners about its periphery and is of substantially the same maximum outer cross-sectional dimensions as the remaining said legs, each of said legs being of slightly greater outermost diagonal dimensions across said corners than the corresponding dimensions across such openings for sliding compressive engagement of said corners with the walls of such openings, and certain said legs being of a significantly different cross-sectional configuration than others of said legs relative to a radial plane through said axis and the center of the respective leg, whereby said corners of said certain of said legs will compressively engage the walls of the respective openings at significantly different angular positions than said corners of the others of said legs when said connector is mounted on such a circuit board, and said certain legs and said other legs being disposed in said predetermined array of said legs such that in each of said relative rotational positions of said connector each of said legs mates into an opening of such circuit board array that is engaged by one of said legs of a different cross-sectional configuration in another of said rotational positions, whereby, following removal of one said electrical connector previously mounted in one such array of holes in one such rotational position, said legs of a said connector inserted in the same array of holes but in a different relative rotational position results in said external corners of each of said legs of the latter connector engaging said walls of said openings in significantly different positions than said corners of said legs of the previously inserted connector, said body including an internal shoulder which divides said bore between a cylindrical base portion open through said one end adjacent said legs and a cylindrical second portion open through the opposite end of said body to receive a dielectric portion of a mating coaxial connector, a hollow cylindrical dielectric member substantially filling said base portion of said bore and seated against said internal shoulder, said body being upset against said dielectric member to retain said member in said body, and a resilient contact pin frictionally mounted in said dielectric member, said contact pin having a first end portion extending into said second open portion and a second end portion extending generally parallel to said legs.

17. The invention as in claim 16 wherein said opposite end of said body is staked against said dielectric member to retain said member in said body.

18. The invention as in claim 16 wherein said contact pin is a one-piece stamped and rolled pin member.

19. The invention as in claim 16 wherein said connector has a longitudinal center axis, each of said legs being a rigid solid element having angularly spaced exposed external corners about its periphery cross-sectional dimensions as the remaining said legs for sliding compressive engagement of said corners with the walls of such openings, and certain of said legs having said corners thereof in different angular positions than others of said legs relative to a radial plane through said axis and the center of the respective leg, whereby said corners of said certain of said legs will compressively engage the walls of the respective openings at different angular positions than said corners of the others of said legs when said connector is mounted on such a member.

20. The invention as in claim 16 wherein said body and said legs are a one-piece diecast element.

* * * * *

UNITED STATES PATENT AND TRADEMARK OFFICE

CERTIFICATE OF CORRECTION

PATENT NO. : 5,752,839

DATED : May 19, 1998

INVENTOR(S) : Fiacco et al.

It is certified that error appears in the above-indentified patent and that said Letters Patent is hereby corrected as shown below:

In Claim 19 at Column 8, line 53 after "periphery" insert --.-- and delete the remainder of the claim.

Signed and Sealed this

Eleventh Day of August 1998

Bruce Lehman

*Attest:*

BRUCE LEHMAN

*Attesting Officer*

*Commissioner of Patents and Trademarks*